US007730840B2

(12) United States Patent
Reichel et al.

(10) Patent No.: US 7,730,840 B2
(45) Date of Patent: Jun. 8, 2010

(54) GIRDER OF A GUIDEWAY FOR A TRACK-BOUND VEHICLE

(75) Inventors: Dieter Reichel, Neumarkt (DE); Stefan Bögl, Sengenthal (DE); Ralf Waidhauser, Neumarkt (DE)

(73) Assignee: Max Bögl Bauunternehmung GmbH & Co. KG, Neumarkt (DE)

( * ) Notice: Subject to any disclaimer, the term of this patent is extended or adjusted under 35 U.S.C. 154(b) by 234 days.

(21) Appl. No.: 11/631,753

(22) PCT Filed: Jun. 27, 2005

(86) PCT No.: PCT/EP2005/052979

§ 371 (c)(1),
(2), (4) Date: Jan. 5, 2007

(87) PCT Pub. No.: WO2006/005676

PCT Pub. Date: Jan. 19, 2006

(65) Prior Publication Data

US 2008/0041266 A1 Feb. 21, 2008

(30) Foreign Application Priority Data

Jul. 8, 2004 (DE) ..... 10 2004 032 979

(51) Int. Cl.
*B60L 13/04* (2006.01)

(52) U.S. Cl. ..... 104/281; 104/282

(58) Field of Classification Search ..... 104/281, 104/282, 284, 286

See application file for complete search history.

(56) References Cited

U.S. PATENT DOCUMENTS 3,842,749 A * 10/1974 Schwarzler ..... 104/286
4,854,028 A * 8/1989 Buchler et al. ..... 29/452
4,856,173 A * 8/1989 Maier et al. ..... 29/445

(Continued)

FOREIGN PATENT DOCUMENTS

DE 3702421 C1 4/1988

(Continued)

OTHER PUBLICATIONS

PCT Search Report, Oct. 5, 2005.

(Continued)

*Primary Examiner*—S. Joseph Morano
*Assistant Examiner*—Jason C Smith
(74) *Attorney, Agent, or Firm*—Dority & Manning, P.A.

(57) ABSTRACT

A track carrier for a railborne vehicle, especially a magnetic suspended railway comprises a concreted plate (2) projecting laterally from the carrier (1). Stators (15, 16) are arranged at the two lateral ends of the plate (2) on the bottom of the plate (2), lateral guide rails (12) are arranged on the lateral surfaces of the plate (2), and glide strips (8) are arranged on the top side of the plate (2) for driving and guiding the vehicle. Hardenable, especially concreted, positionally correct contact surfaces (5, 6, 7) for the lateral guide rails (12) and/or for the stators (15, 16) and/or for the glide strips (8) are formed on the carrier (1), and the lateral guide rails (12) and/or the stators (15, 16) and/or the glide strips (8) are detachably arranged on, especially screwed to the contact surfaces (5, 6, 7) provided for them.

12 Claims, 4 Drawing Sheets

U.S. PATENT DOCUMENTS

| | | | | |
|---|---|---|---|---|
| 4,905,359 | A * | 3/1990 | Maier et al. | 29/33.52 |
| 4,909,474 | A * | 3/1990 | Buchler et al. | 249/1 |
| 4,970,773 | A * | 11/1990 | Buchler et al. | 29/407.05 |
| 5,370,059 | A * | 12/1994 | Raschbichler et al. | 104/124 |
| 5,850,794 | A * | 12/1998 | Raschbichler et al. | 104/281 |
| 6,782,832 | B2 * | 8/2004 | Reichel et al. | 104/124 |
| 6,889,616 | B1 * | 5/2005 | Heddrich et al. | 104/292 |
| 2003/0177938 | A1 * | 9/2003 | Reichel et al. | 104/282 |
| 2005/0115455 | A1 * | 6/2005 | Baumann | 104/281 |
| 2005/0166786 | A1 * | 8/2005 | Reichel et al. | 104/124 |
| 2007/0034106 | A1 * | 2/2007 | Miller et al. | 104/286 |
| 2008/0041266 | A1 * | 2/2008 | Reichel et al. | 104/281 |

FOREIGN PATENT DOCUMENTS

| | | | |
|---|---|---|---|
| DE | 4115936 | A1 | 11/1992 |
| DE | 198 29 903 | A1 | 6/2003 |
| DE | 102 12 090 | A1 | 10/2003 |
| DE | 102 49 091 | A1 | 4/2004 |
| DE | 102 53 827 | A1 | 5/2004 |
| DE | 103 12 561 | A1 | 9/2004 |
| DE | 103 46 105 | A1 | 4/2005 |

OTHER PUBLICATIONS

International Preliminary Report on Patentability, Feb. 23, 2007.
German Patent Office Search Report, Jun. 3, 2005.

* cited by examiner

GIRDER OF A GUIDEWAY FOR A TRACK-BOUND VEHICLE

FIELD OF THE INVENTION

The present invention relates to a track carrier for a railborne vehicle, especially a magnetic suspended railway, in which the carrier comprises a laterally projecting concreted plate, and stators are arranged on the two lateral ends of the plate on the bottom of the plate, lateral guide rails are arranged on the lateral surfaces of the plate, and glide strips are arranged on the top of the plate for driving and guiding the vehicle.

BACKGROUND

DE 37 16 260 C1 teaches a method for adjusting and fastening functional surfaces of a track of an electromagnetic high-speed railway. Lateral guide rails are brought into a required position after the adjusting and fastening of stators, positioned opposite the track carrier and then fastened to the track carrier. The lateral guide rails are fastened at their ends to steel anchoring bodies previously embedded in the track carrier by welding, or connected to the track carrier via anchoring bolts by casting with hardening material. The glide strips, that consist of a very superelevated protuberance on the top of the carrier, are milled and ground to the required size. This design has the disadvantage that very expensive apparatuses are required for positioning the lateral guide rails and for working the glide strips. In addition, the apparatuses must position the lateral guide rails until the hardening material has hardened and the lateral guide rails are fixed. The production of such a track is therefore very time-intensive and thus cost-intensive.

SUMMARY

The present invention has the problem of creating a carrier that can be produced in a particularly rapid and economical manner and can be provided with functional surfaces. Additional objects and advantages of the invention will be set forth in the following description, or may be obvious from the description, or may be learned through practice of the invention.

According to the embodiments of invention, the track carrier for a railborne vehicle, especially for a magnetic suspended railway, comprises a concreted plate projecting laterally out of the carrier. Stators are arranged on the two lateral ends of the plate on the bottom of the plate, lateral guide rails are provided on the lateral surfaces of the plate, and glide strips are provided on the top of the plate for driving and guiding the vehicle. Hardenable contact surfaces, in particular concreted contact surfaces, for the lateral guide rails and/or for the stators and/or for the glide strips are present on the carrier. The lateral guide rails and/or the stators and/or the glide strips are preferably screwed onto the contact surfaces provided for this purpose.

The contact surfaces are produced together with the carrier. This means that they are preferably produced at the same time as the manufacture of the carrier or also thereafter. It is important that the add-on parts are screwed onto the contact surfaces only after the manufacture of the contact surfaces has been completed.

In contrast to the state of the art, contact surfaces are provided that are integrated into the carrier. A positioning of the add-on parts during the casting of the add-on parts with the carrier is consequently not necessary. After a positionally correct production of the contact surfaces, that is in accordance with the requirements of the magnetic suspended railway and of the line in which the carrier is to be integrated, the add-on parts lateral guide rail, stator and/or glide strip can be directly arranged, in particular screwed on. This makes possible a rapid, economical and simple mounting. The add-on parts consist of very simple constructed structural parts that are extremely economical to manufacture. Even the demounting of the add-on parts, e.g., for repair or for replacing damaged add-on parts, can be carried out in a rapid and simple manner since the add-on parts are detachably arranged on the contact surfaces and can therefore be rapidly replaced. The lateral guide rails, stators or glide strips are preferably designed independently from each other so that they can be mounted and demounted individually. The contact surface in accordance with the invention does not have to be provided for all add-on parts. It is sufficient if, e.g., only the lateral guide rails or the stators are screwed onto the contact surfaces provided for this purpose. The contact surfaces themselves can already assume the guiding function of the vehicle. Thus, it can be sufficient, especially for the glide strips, if they consist themselves of the contact surfaces. A separate structural component of the glide strips is therefore not required.

It is particularly advantageous if the carrier is a precast concrete part. In this case, it's not necessary that the complete carrier is designed as a precast concrete part. A combined construction can also be used in which, e.g., the plate is a precast concrete part and the carrier substructure is manufactured from steel.

If the contact surfaces are largely in the correct position, in particular concreted in accordance with predetermined variants of the carrier, no processing or only a slight working of the contact surfaces is required prior to the mounting of the add-on parts. Variants of the carrier, e.g., for being included in a curve or in straight sections of the line, can therefore be basically provided during the manufacture of the carrier already.

It is particularly advantageous if the carrier is designed in such a manner that one of the contact surfaces forms a concreted glide strip. As a result, the mounting of a separate add-on part for the glide strip is not necessary. As a result of the precisely designed contact surface running along the carrier, this contact surface can serve directly as a placement surface for the vehicle. The strength of the concrete is sufficient, so that a steel strip provided solely for that purpose is not necessary.

In order to avoid damage to the vehicle or to the carrier when the vehicle is placed on the guide strip, a preferred embodiment of the invention can provide that the concreted guide strip is coated. For example, plastics that are applied onto the concreted guide strip can be provided as coating materials.

The concreted glide strip and/or the contact surfaces are advantageously worked after a storage time of the concreted plate. As a result, unavoidable changes in size during the setting time of the concrete carrier are waited for in order to then be able to create a lasting, positionally correct contact surface or concreted glide strip. If the working were to take place too early, a contact surface that was originally exactly worked would change within a few days together with the concreted carrier as regards its dimension in such a manner that the admissible variations in dimension for the contact surface would be exceeded.

The hardenable contact surfaces are advantageously worked mechanically, especially milled and/or ground. This achieves precisions that meet the extremely high requirements of a magnetic suspended railway and ensure the traveling operation of the vehicle. In order to fasten the lateral guide rails, clamping means, especially at least one stranded tensioning wire or a traction anchor is provided with which the lateral guide rails are connected to the carrier. This ensures a positionally precise and largely unchangeable fastening of the lateral guide rails to the carrier.

In order to connect the lateral guide rails and/or the stators and/or the glide strips to the carrier, it is provided in an especially advantageous manner that fastening means, especially threaded casings and/or casing-nut inserts are integrated into the carrier in the area of the formed contact surfaces. The fastening means can be concreted into the carrier during the manufacture of the carrier or of the plate. The front sides of the threaded casings and/or casing-nut inserts can be worked together with the contact surfaces as needed so that a positionally accurate contact surface is produced for the add-on parts. Then, the lateral guide rails, stators and/or guide strips are screwed to the carrier by screws and the integrated fastening means. In order to obtain the required dimension of the add-on parts to each other for a flawless guiding and driving of the magnetic suspended railway, it is understood that the lateral guide rails as well as the stators and, if necessary, the glide strips were also manufactured to an exact dimension in order to obtain in cooperation with the positionally correct contact surfaces the prescribed tong dimension between the individual add-on parts. The maintaining of small variations in dimension of the add-on parts can be maintained in a very simple manner on account of the simple design of the add-on parts that is made possible by the contact surfaces integrated in the carrier.

For example, in order to avoid a mechanical working or to make it necessary only in a very small dimension, it is particularly advantageous if the hardenable contact surfaces were already formed in the correct position or largely in the correct position by the setting of the production form during the concreting of the plate. The sheathing is made variable and adjustable here in the area of the contact surfaces in order to adapt the contact surfaces to the requirements placed on the carrier for the insertion into the line. Thus, e.g., if there is a warping of the carrier, the course of the contact surfaces can deviate from the course of the carrier in order to ensure an orderly guiding of the vehicle.

It is advantageous, depending on the requirement, if the hardenable contact surfaces are designed either continuously or discontinuously along the plate. A continuous design of the contact surfaces is appropriate especially for the glide strips and the stators. The discontinuous design of the contact surfaces is especially advantageous for the lateral guide rails. The particular advantage here is that rainwater or melted water that collects on the top of the carrier can flow off between the carrier and the lateral guide rails through the interval produced between the hardenable contact surfaces. A separate apparatus for removing rainwater or melted water from the top of the carrier is consequently no longer required. Furthermore, the lateral guide rails are kept largely free of water, as a result of which, especially in winter, an icing of the lateral guide rails and therewith a significant altering of the dimension and consequently a disturbing of the traveling operation of the vehicle are reliably avoided.

In order to achieve an especially good guiding of the stators, it is advantageous if the hardenable contact surfaces on one side of the plate form two parallel protuberances. The stators or the stator holders are arranged on the protuberances. Again, screwing is particularly advantageous for this purpose since it can be rapidly performed and in particular a replacement in the case of defective stators or stator holders is advantageous.

It is novel and inventive if the plate between the two parallel glide strips is designed to be elevated opposite the glide strips. Whereas it was previously customary to design the glide strips as protuberances on the top of the plate, a stepped course or one that falls off toward the outside is provided for the top of the plate and the glide strips are arranged lower than the top of the plate between the two glide strips of the plate. This ensures that rainwater and melted water collecting on top of the carrier or of the plate can flow off to the lateral outer sides of the plate. Thus, a backup between the two protuberances of the glide strips of the state of the art no longer takes place. As a result, a separate apparatus for removing rainwater and melted water is no longer required and consequently the carrier can again be designed to be significantly more economical.

It is of course particularly advantageous if the top of the plate is designed to be stepped or falls off starting from its longitudinal axis via the glide strips to the lateral guide rails. In this manner it can be ensured even in the case of a continuous fastening of the lateral guide rails that the water from the top of the plate also runs off, if applicable, via the lateral guide rails. In addition, it is ensured that no backup takes place between the lateral guide rails and the guide strips, which would also possibly cause a disturbance of the traveling operation, especially in the case of heavy rain or icing of the carrier.

Further advantages of the invention are described in the following exemplary embodiments.

DESCRIPTION

Figure 1:
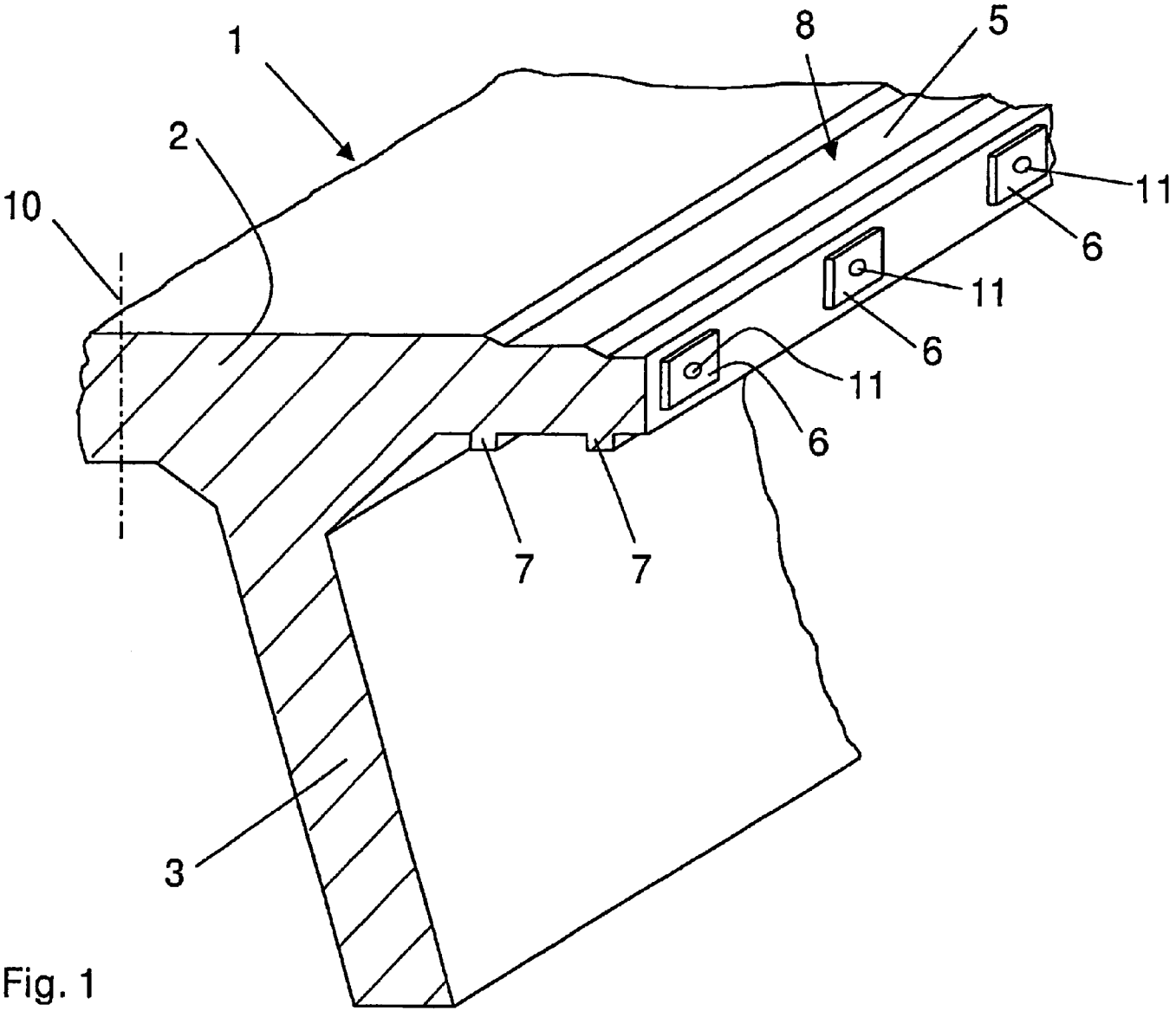
FIG. 1 shows a perspective top view of a carrier section.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows carrier 1 consisting substantially of plate 2 and webs 3. Only one half of carrier 1 and therefore only one web 3 is shown for reasons of clarity. Carrier 1 is designed as a precast concrete part, is manufactured in the form shown in a plant for precast concrete parts and is subsequently transported to a line for a track for a railborne vehicle, especially a magnetic suspended railway.

Plate 2 projects in the form of a cantilever past web 3. The lateral end of plate 2 is provided for guidance and for adding guide and drive parts of the vehicle. The add-on parts required for guiding and driving the magnetic suspended railway consist on the top of carrier 1 of at least one, usually two glide strips for placing the vehicle, on each lateral end of plate 2 of a lateral guide rail for the lateral guidance of the vehicle, and on the bottom of plate 2 of stators and their suspension for driving the vehicle.

In embodiments of the present invention, plate 2 is provided with contact surfaces 5, 6 and 7. Contact surface 5 is designed in such a manner in the present exemplary embodiment that it already functions itself as glidestrips. The surface of glide strip 5 is ground so that it already maintains the predetermined dimension of the glide strip. Moreover, contact surface 5 has a continuous design, as a result of which a magnetic suspended railway can glide to a standstill when placed on contact surface 5. Contact surface 5 is furthermore arranged in a stepped manner in comparison to the surface of plate 2 arranged in the area of a central line 10 of carrier 1. Another step is provided at the end of plate 2. As a result, rainwater or melted water collecting on the top of plate 2 is removed to the edge of the cantilever, where it can flow off. An additional flow-off system on plate 2 for water is consequently not necessary. The step need of course not be designed so saliently as shown in FIG. 1. It can also be continuous or arched. However, it is essential that a flowing off of the surface water from carrier 1 without a rather large amount of the water collecting on the surface of carrier 1 is ensured.

Contact surfaces 6 are arranged discontinuously on the outer lateral front surfaces of plate 2. Threaded casings 11 are let into the concrete of plate 2 in the area of contact surfaces 6. A lateral guide rail is screwed to threaded casings 11 after the working of contact surface 6.

The working of contact surfaces 6 takes place just as in the case of contact surfaces 5, 7 by milling and/or grinding. This makes possible particularly exact surfaces and small tolerances. An accurate to dimension lateral guide rail that is screwed to contact surfaces 6 thus makes possible an exact association with stators to be subsequently described and with lateral guide rails that are arranged on the opposite side of plate 2. The tong dimension produced thereby is decisive for a liable and exact guidance of the vehicle on carrier 1.

The other contact surfaces 7 are provided on the bottom of the cantilever of plate 2. Contact surfaces 7, that run just as contact surface 5 continuously along carrier 1, serve for the fastening of the stators. Threaded casings 18 can also be let into contact surfaces 7 to which casings the stators or their carriers can be screwed. The intersection of contact surfaces 7 to the carriers of the stators are also milled and/or ground in order to obtain an exact dimension that must be maintained, in particular as concerns contact surface 5.

Another strip can be fastened to contact surface 5, e.g., also via dowel pin connections and screw connections on contact surface 5 if contact surface 5 is not to be used itself as glide strip. Even in this instance, the glide strip and contact surface 5 are advantageously designed in such a manner that they are arranged lower than the middle surface of plate 2 and are elevated relative to the lateral edge in order to make it possible for water to flow off to the lateral edge of plate 2.

Figure 2:
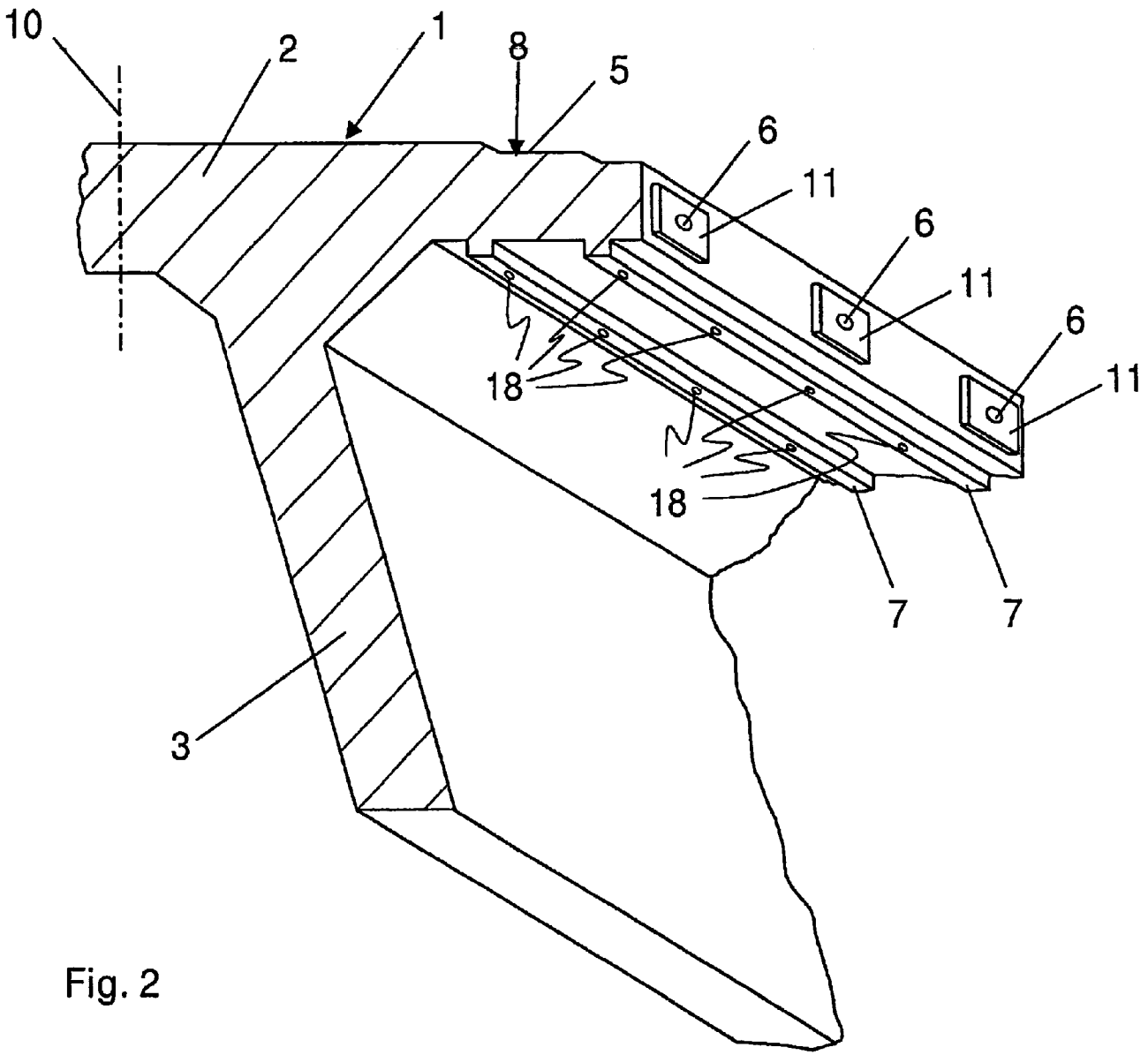
FIG. 2 shows a perspective bottom view of a carrier section.

FIG. 2 shows a perspective view from below onto a carrier 1. Carrier 1 corresponds in essence to carrier 1 in FIG. 1. In particular, the continuous arrangement of contact surfaces 7 becomes clear from this representation. However, the invention is not limited to the continuous arrangement of contact surfaces 7. This contact surface 7 can absolutely also be designed discontinuously in that an appropriate contact surface 7 is merely provided at the locations at which the stator or the stator suspensions are to be fastened. The advantage of discontinuous contact surface 7 is that less working of material is required in order to be able to arrange the stators in the proper position. This makes the working less expensive and thus more economical.

Casing-nut inserts 18 for fastening the stators are concreted in in the area of contact surfaces 7. The stator suspensions are screwed to casing-nut inserts 18.

Contact surfaces 6 are again designed to be discontinuous on the outer front sides of plate 2. This produces intermediate spaces between the lateral guide rail and plate 2 between the individual contact surfaces 6 after the addition of lateral guide rails. These intermediate spaces are suitable for letting the water collected on the surface of plate 2 to flow off without the water having to flow over the lateral guide rails. This is particularly advantageous in winter since it keeps the lateral guide rails from freezing over, which could limit the travel operation of the vehicle.

Figure 3:
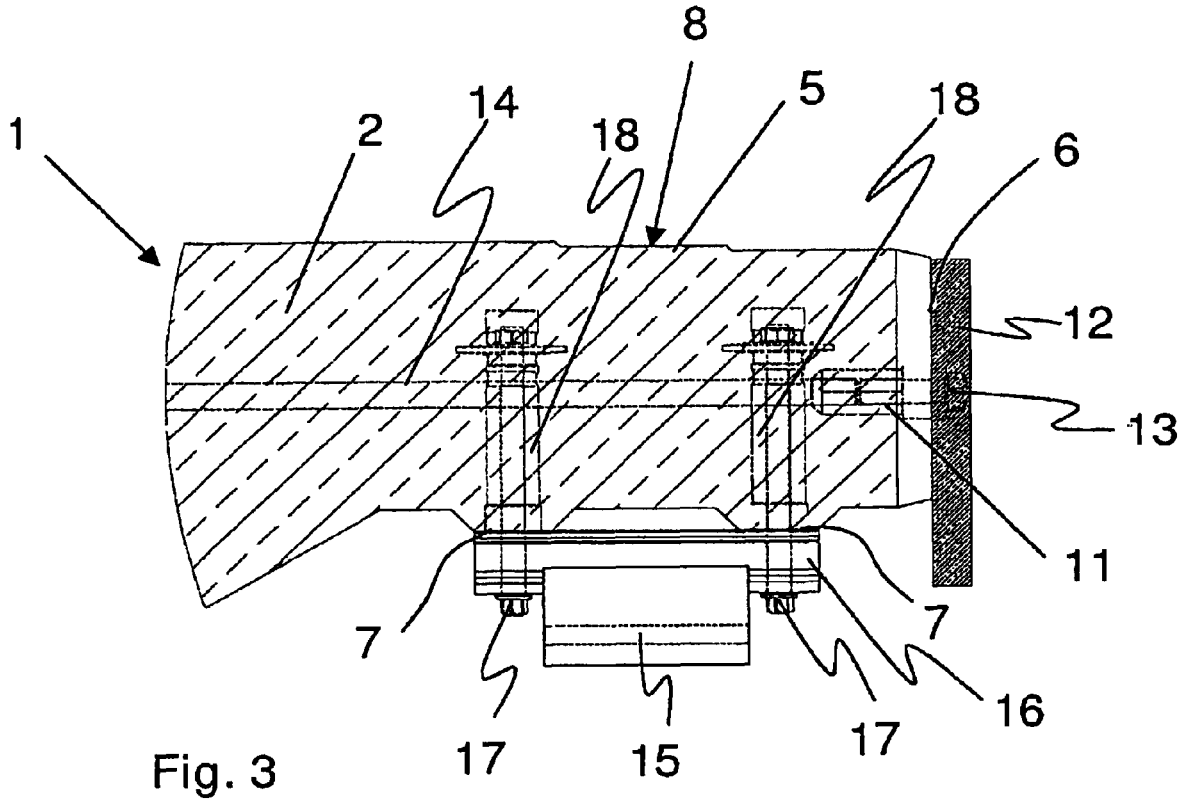
FIG. 3 shows a detailed view of a lateral plate end 1.

FIG. 3 shows a detailed view of a cantilever of a plate 2. A lateral guide rail 2 is connected on contact surface 6 via screw 13 to threaded casing 11. Lateral guide rail 12 is pressed here via screw 13 against the worked surface of contact surface 6. Threaded casing 11 is cast into the concrete of plate 2. It is firmly anchored in plate 2 via tensioning rod 14. The end of tensioning rod 14 (not shown) empties, e.g., into another threaded casing (not shown) that serves for the fastening of the opposite lateral guide rail 12.

Stator 15 for driving the vehicle is fastened on the bottom of the cantilever of plate 2. Stator 15 is arranged in the present exemplary embodiment on stator suspension 16 that is connected in accordance with the principle of a groove-spring connection to stator 15. Stator suspension 16 is screwed with screws 17 in casing-nut insert 18 cast in the concrete of plate 2. Stator suspension 16 is pressed against the worked surfaces of contact surfaces 7 and as a consequence brings stator 15 into the predetermined position. Of course, other forms of stator suspension 16 are also possible that do not fasten stator 15 in the form of a groove-spring connection but rather fix stator 15, e.g., with screws, bolts or casings.

If the casings of casing-nut inserts 18 are designed to be slightly conical to the nut, on the one hand the introduction of screw 17 into casing-nut insert 18 is facilitated and on the other hand it makes possible an angular offset between the casing axis and the screw axis of several degrees for the mounting of stators 15. This makes it very simple to be able to adapt stators 15 to the desired position. The anchoring of casing-nut insert 18 in the concrete takes place by a large washer in the area of the nut.

The top of plate 2 is again designed to be stepped. The steps bring it about that plate 2 is stepped downward from the center of plate 2 to the lateral edge of plate 2. As a result, water that collects on the surface of plate 2 is conducted to the side of plate 2. The stepping is also provided for contact surface 6 by a slant that continues to the also deeper placed lateral guide rail 12. In addition to the stepping shown here, another form of the slant can of course also be produced, e.g., with a slightly arched surface of plate 2 or with a sloping plane of the surface of plate 2 in which contact surface 5 or the glide strip formed from it is ground in as a horizontal level surface.

Figure 4:
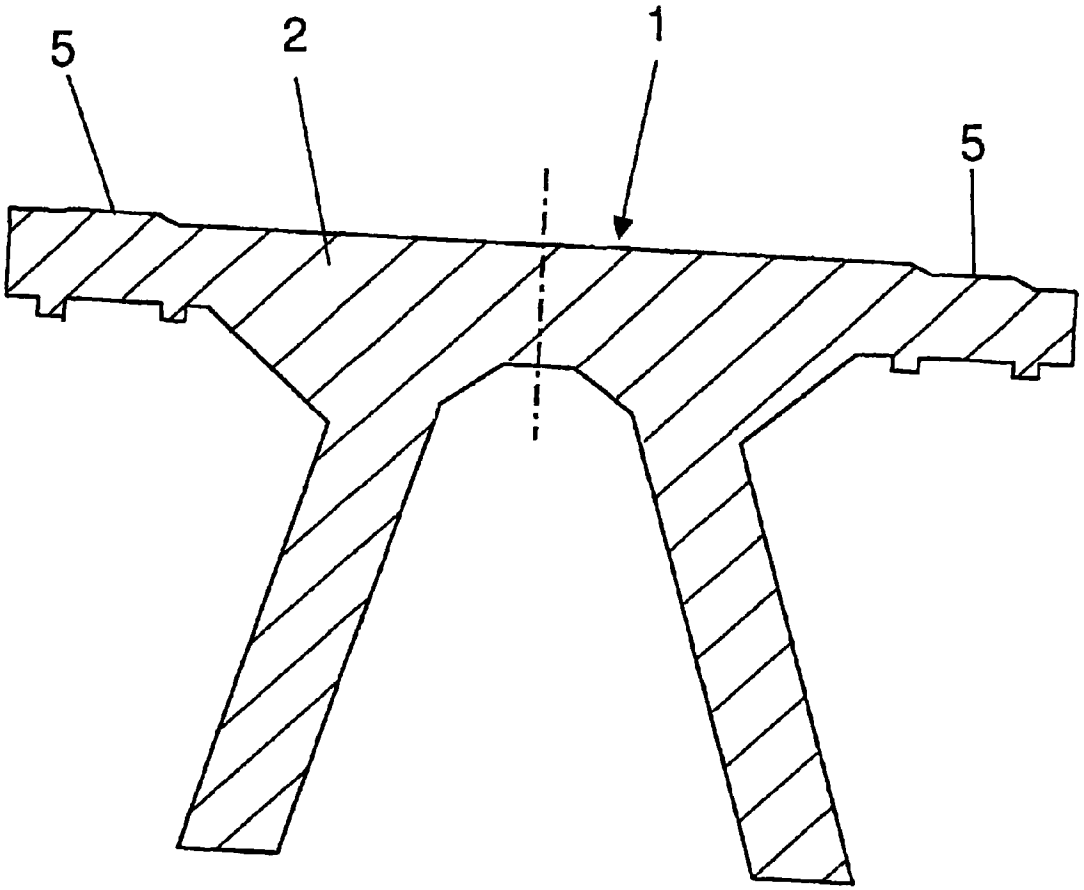
FIG. 4 shows a cross section through an obliquely placed carrier.

FIG. 4 shows a cross section through obliquely positioned carrier 1. The oblique position, that is, a horizontal inclination of a few degrees brings it about that water can run off from the surface of carrier 1. In order to avoid accumulations of water on carrier 1 the elevations for forming contact surfaces 5 are designed in such a manner that no elevations or hardly any elevations but rather substantially only graduations are provided in the direction of the lowered end of carrier 1. This ensures a reliable travel operation even in heavy rain events.

The present invention is not limited to the exemplary embodiments shown. In particular, combinations of the individual elements of the invention are of course possible. Thus, it is absolutely possible that only the lateral guide rail can be arranged in accordance with the principle of the invention whereas the fastening of the glide strip or of the stator suspension takes place according to another principle.

The invention claimed is:

1. A track carrier for a railborne vehicle, comprising:

a carrier with a concrete plate having lateral ends extending from a web, with stator components attached at bottom surfaces of said lateral ends, guide rails attached to outward lateral sides of said lateral ends, and vehicle glide strips configured on a top surface of said concrete plate;

a plurality of spaced apart hardened concrete contact surfaces formed directly in the material of said concrete plate along said outward lateral sides of said lateral ends, said contact surfaces extending outwardly from an outward surface of said outward lateral sides and defining uniquely shaped and located points for detachable attachment of said lateral guide rails such that a space is defined between said lateral guide rails and said outward surface of said outward lateral sides between said contact surfaces; and said contact surfaces having an outwardly extending dimension with respect to said outward surface of said outward lateral sides such that an exact overall tolerance for said guide rails that are subsequently attached to said contact surfaces is achieved with respect to said outward lateral sides.

2. The track carrier of claim 1, wherein said carrier is a precast concrete part.

3. The track carrier of claim 1, wherein said vehicle glide strips are also formed directly by additional contact surfaces formed in said top surface of said concrete plate.

4. The track carrier of claim 3, wherein said vehicle glide strips comprise a coating on said contact surfaces.

5. The track carrier of claim 1, wherein said contact surfaces are defined into said concrete plate after initial formation and dimensional stabilization of said concrete plate.

6. The track carrier of claim 5, wherein said contact surfaces are mechanically worked into said concrete plate by one of a milling or grinding process.

7. The track carrier as in claim 1, further comprising tensioning means for connecting said guide rails to said concrete surfaces.

8. The track carrier as in claim 1, further comprising fastening devices provided in said contact surfaces for detachable attachment of said lateral guide rails, said stator components, or said glide strips.

9. The track carrier as in claim 8, wherein said fastening devices comprise threaded casing inserts.

10. The track carrier as in claim 1, further comprising additional contact surfaces defined along said bottom surfaces of said lateral ends for said stator components, said additional contact surfaces comprising two parallel protuberances defined on said bottom surface of said lateral ends.

11. The track carrier as in claim 1, wherein said top surface of said concrete plate is elevated between said glide strips such that water on said top surface flows laterally towards said glide strips at said lateral ends of said concrete plate.

12. The track carrier as in claim 11, wherein said top surface of said concrete plate is stepped between opposite said glide strips at each said lateral end of said concrete plate such that water flows from between said glide strips towards said guide rails.

* * * * *